US012127619B2

(12) United States Patent
Mayo

(10) Patent No.: US 12,127,619 B2
(45) Date of Patent: Oct. 29, 2024

(54) METHOD OF PREPARING ZIPPER ASSEMBLIES FOR APPAREL MANUFACTURING PROCESSES

(71) Applicant: IDEAL FASTENER CORPORATION, Miami, FL (US)

(72) Inventor: William Mayo, Raleigh, NC (US)

(73) Assignee: IDEAL FASTENER CORPORATION, Miami, FL (US)

( * ) Notice: Subject to any disclaimer, the term of this patent is extended or adjusted under 35 U.S.C. 154(b) by 207 days.

(21) Appl. No.: 18/083,130

(22) Filed: Dec. 16, 2022

(65) Prior Publication Data

US 2023/0189913 A1 Jun. 22, 2023

Related U.S. Application Data

(60) Provisional application No. 63/292,394, filed on Dec. 21, 2021.

(51) Int. Cl.
*A41H 37/00* (2006.01)
*A44B 19/62* (2006.01)

(52) U.S. Cl.
CPC ..... *A41H 37/003* (2013.01); *A44B 19/62* (2013.01)

(58) Field of Classification Search
CPC ..... A44B 19/62; A44B 19/42; A41H 37/003
See application file for complete search history.

(56) References Cited

U.S. PATENT DOCUMENTS 2,166,350 A 7/1939 Freshman
2,170,609 A 8/1939 Nedal
2,708,968 A 5/1955 Soave
2,838,112 A 6/1958 Feitl
2,838,831 A 6/1958 Aubuchon
2,868,288 A 1/1959 Feitl
3,081,462 A 3/1963 Radovsky
3,225,429 A 12/1965 Fady
3,263,238 A 8/1966 Waldes
3,340,594 A 9/1967 Frohlich et al.
3,530,563 A 9/1970 Maeda
(Continued)

FOREIGN PATENT DOCUMENTS

CN 106687006 A 5/2017
CN 107072409 A 8/2017
(Continued)

OTHER PUBLICATIONS

"International Search Report" and "Written Opinion of the International Search Authority" (ISA/US) in Ideal Fastener Corporation, International Patent Application Serial No. PCT/US2022/053228, dated Mar. 10, 2023 (7 pages).

*Primary Examiner* — Moshe Wilensky
(74) *Attorney, Agent, or Firm* — Tillman, Wright & Wolgin; Neal Wolgin; David Higgins

(57) ABSTRACT

A method for preparing discontinuous zipper chain for use in apparel manufacturing includes: programming a teeth-securing machine to secure zipper teeth at specified intervals along an edge of each of a pair of zipper tapes; feeding the pair of zipper tapes into the teeth-securing machine so as to secure interlocking zipper teeth to the zipper tapes at the specified intervals, thereby forming a discontinuous zipper chain having successive toothed sections positioned along a length thereof and spaced apart from one another by gap sections without zipper teeth; and spooling or packaging the discontinuous zipper chain for use in apparel manufacturing.

19 Claims, 8 Drawing Sheets

(56) References Cited

U.S. PATENT DOCUMENTS

| | | | |
|---|---|---|---|
| 3,875,647 | A | 4/1975 | Yoshida |
| 3,956,812 | A | 5/1976 | Kawakami et al. |
| 4,000,545 | A | 1/1977 | Takamatsu |
| 4,238,872 | A | 12/1980 | Akashi |
| 4,293,994 | A | 10/1981 | Moertel |
| 4,324,034 | A | 4/1982 | Berry et al. |
| 4,362,487 | A | 12/1982 | Takahashi |
| 4,428,264 | A | 1/1984 | Shimai |
| 5,142,772 | A | 9/1992 | Ishikawa |
| 5,212,863 | A | 5/1993 | Matsumoto |
| 5,806,163 | A | 9/1998 | Shimai et al. |
| 9,295,307 | B2 | 3/2016 | Tominaga et al. |
| 9,944,028 | B1 | 4/2018 | Davis et al. |
| 10,144,186 | B1 | 12/2018 | Davis et al. |
| 10,925,354 | B1 | 2/2021 | Mayo et al. |
| 2005/0197240 | A1 | 9/2005 | Woody et al. |
| 2007/0169318 | A1 | 7/2007 | Semons |
| 2012/0137476 | A1 | 6/2012 | La Rocca et al. |
| 2013/0232738 | A1 | 9/2013 | Tominaga et al. |
| 2016/0073743 | A1 | 3/2016 | Davis et al. |
| 2016/0081437 | A1 | 3/2016 | Davis |
| 2018/0008053 | A1 | 1/2018 | Davis |
| 2020/0086596 | A1 | 3/2020 | Davis et al. |

FOREIGN PATENT DOCUMENTS

| | | | |
|---|---|---|---|
| EP | 3190917 | | 7/2017 |
| JP | 2017-527391 | A | 9/2017 |
| JP | 2017-529167 | A | 10/2017 |
| WO | 2016040726 | A1 | 3/2016 |
| WO | 2016049121 | A1 | 3/2016 |
| WO | 2023121980 | A1 | 6/2023 |

110

210

METHOD OF PREPARING ZIPPER ASSEMBLIES FOR APPAREL MANUFACTURING PROCESSES

CROSS-REFERENCE TO RELATED APPLICATIONS

The present application is a U.S. nonprovisional patent application of, and claims priority under 35 U.S.C. § 119(e) to, U.S. provisional patent application Ser. No. 63/292,394, filed Dec. 21, 2021, and entitled, "METHOD OF PREPARING ZIPPER ASSEMBLY FOR GARMENT MANUFACTURING PROCESSES," which provisional patent application is incorporated by reference herein in its entirety.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE PRESENT INVENTION

Field of the Present Invention

The present invention relates generally to processes for preparing zipper assemblies, and, in particular, to processes for preparing individual zipper assemblies in bulk for implementation as zipper flies in pants or jeans.

Background

Pants and jeans garments commonly include metal-teeth zippers as a zipper fly. When manufacturing these garments, apparel manufacturers utilize spools of continuous zipper chain that are acquired and then processed internally. Continuous zipper chain generally includes two rows of interlocking metal teeth, with each row secured to a respective zipper tape. The rows of teeth are interlocked with one another, or zipped, to form the continuous chain.

FIG. 1 is a flowchart of a conventional method 10 for processing continuous zipper chain to form individual zipper assemblies for use in apparel manufacturing. At step 15 of the method 10, a spool of continuous zipper chain is acquired for processing. In this regard, FIG. 2A is a perspective view of a spool 12 containing continuous zipper chain 14 for use in apparel manufacturing, and FIG. 2B is a close-up perspective view of a portion of the continuous zipper chain 14 of FIG. 2A.

At step 25 of the method 10 of FIG. 1, a first machine is used to secure zipper fly flaps for pants or jeans to the continuous zipper chain. In many instances, the first machine is a sewing machine that sews flaps to one or both of the zipper tapes of the continuous zipper chain in an end-to-end, continuous manner. The flaps are commonly formed of a fabric material of the type that is preferred for the particular garment to be made (usually of the same type of material as the garment). Flaps are affixed to the rear side of the zipper chain, i.e., the side that will ultimately face the interior of the garment. FIG. 3 is a close-up perspective view of a portion of the continuous zipper chain 14 of FIG. 2A with flaps 16 sewn thereto. The length of each flap 16 corresponds with the target length of the finished individual zipper assembly, as each finished assembly includes one flap.

At step 35 of the method of FIG. 1, a second machine is used to remove teeth from the continuous zipper chain to form gaps along the length thereof. The second machine is commonly a gapping or die punch machine that is used to mechanically remove a fixed number of metal teeth from the cord on the inside edge of the zipper tapes. In this regard, FIG. 4A is a perspective view of a gapping machine 18 having a die punch 20. The gapping machine 18 punctures the continuous zipper chain 14 as the chain is maneuvered beneath the die punch 20. Zipper teeth 22 are removed with each puncture of the zipper chain 14. Following gapping at step 35, the resulting chain includes gap sections, without metal teeth, at spaced-apart locations along the chain length. Since the removed teeth 22 are scrap metal, the size of the gap is generally made as small as practical while still allowing further processing at step 45. In this latter regard, FIG. 4B is a perspective view of a zipper chain 14 having teeth removed therefrom to form gap sections 24 along the length thereof.

At step 45 of the method of FIG. 1, a third machine is used to insert a slider body and zipper stops at or adjacent each gap section along the zipper chain. The gap sections, without metal teeth, provide locations to accommodate hardware corresponding to each separate length of zipper chain so that each is independently functional as a zipper assembly. The slider body is positioned onto the metal teeth so that the teeth from each zipper tape can be zipped or unzipped, and the zipper stops provide a physical obstacle at the ends of each section of zipper chain to prevent the slider body from exiting the teeth. At step 55 of the method of FIG. 1, the third machine is also used to introduce cuts to the zipper chain at each of the gap sections, thereby forming individual zipper assemblies, each of which can be sewn to a garment for use as a zipper fly.

In accordance with FIG. 1, conventional methodology for processing continuous zipper chain utilizes at least three different machines (at steps 25, 35, and 45/55) to process an acquired spool of zipper chain into individual zipper assemblies, each capable of installation as a functioning zipper. Use of these different machines is linear (i.e., one after another), which tends to make the assembly process time intensive.

Moreover, removing metal teeth at step 35 of the method represents a notable inefficiency of conventional methodology. For assembly of a typical zipper assembly for jeans or pants, approximately 15% of the metal teeth from the acquired continuous zipper chain are removed at step 35 due to the length of the formed gap relative to the overall length of the finished zipper assembly. Removed metal material can be sold or recycled, but removed teeth are worth far less as scrap metal material than the virgin metal wire from which the teeth are formed.

Further still, there is inefficiency built into the shipping cost for acquiring continuous zipper chain. Notably, shipping costs for zipper chain tend to be based on actual shipping weight of the material acquired. However, a built-in inefficiency can be appreciated when it is considered that the cost to acquire continuous zipper chain would necessarily include the weight of material that is ultimately discarded as part of the manufacturing process (i.e., removed teeth).

Thus, a need exists for greater efficiency in the process of preparing zipper assemblies for use in apparel manufacturing. This and other needs are addressed by one or more aspects of the present invention.

SUMMARY OF THE PRESENT INVENTION

Some exemplary embodiments of the present invention may overcome one or more of the above disadvantages and other disadvantages not described above, but the present invention is not required to overcome any particular disadvantage described above, and some exemplary embodiments of the present invention may not overcome any of the disadvantages described above.

Broadly defined, the present invention according to one aspect includes a method for preparing discontinuous zipper chain for use in garment or apparel manufacturing processes. The method includes: programming a teeth-securing machine to secure zipper teeth along running lengths of two zipper tapes at specified intervals; feeding zipper tapes into the teeth-securing machine to secure zipper teeth to the zipper tapes at the specified intervals, thereby forming a discontinuous zipper chain having gapped locations without zipper teeth in between adjacent sections of zipper teeth along a length thereof; and spooling or packaging the discontinuous zipper chain for use in garment or apparel manufacturing processes.

In a feature of this aspect, the discontinuous zipper chain includes metal zipper teeth. In another feature of this aspect, the discontinuous zipper chain includes polymeric zipper teeth. In another feature of this aspect, the discontinuous zipper chain includes coil-type zipper teeth.

In another feature of this aspect, the specified intervals are uniform across the length of the discontinuous zipper chain.

Broadly defined, the present invention according to another aspect includes a method for processing discontinuous zipper chain to form individual zipper assemblies for use in garment or apparel manufacturing. The method includes: acquiring a supply of a discontinuous zipper chain having a series of gaps without zipper teeth; using a first machine, securing flaps to the discontinuous zipper chain; using a second machine, inserting a slider body and one or more stops at the gaps along the discontinuous zipper chain; and using the second machine, introducing cuts to the discontinuous zipper chain at the gaps to form individual zipper assemblies for use in garment or apparel manufacturing.

In a feature of this aspect, the first machine is a sewing machine.

In another feature of this aspect, the flaps are zipper fly flaps for pants or jeans garments.

In another feature of this aspect, the discontinuous zipper chain includes metal zipper teeth. In another feature of this aspect, the discontinuous zipper chain includes polymeric zipper teeth. In another feature of this aspect, the discontinuous zipper chain includes coil-type zipper teeth.

Broadly defined, the present invention according to another aspect includes a method for preparing discontinuous zipper chain for use in apparel manufacturing. The method includes: programming a teeth-securing machine to secure zipper teeth at specified intervals along an edge of each of a pair of zipper tapes; feeding the pair of zipper tapes into the teeth-securing machine so as to secure interlocking zipper teeth to the zipper tapes at the specified intervals, thereby forming a discontinuous zipper chain having successive toothed sections positioned along a length thereof and spaced apart from one another by gap sections without zipper teeth; and spooling or packaging the discontinuous zipper chain for use in apparel manufacturing.

In a feature of this aspect, the discontinuous zipper chain includes metal zipper teeth. In another feature of this aspect, the discontinuous zipper chain includes polymeric zipper teeth. In another feature of this aspect, the discontinuous zipper chain includes coil-type zipper teeth.

In another feature of this aspect, an interval length of each specified interval is uniform along the length of the discontinuous zipper chain.

Broadly defined, the present invention according to another aspect includes a method for processing discontinuous zipper chain to form individual zipper assemblies for use in apparel manufacturing. The method includes: acquiring a supply of a discontinuous zipper chain having successive toothed sections positioned along a length thereof and spaced apart from one another by gap sections without zipper teeth; securing flaps to the discontinuous zipper chain using a first machine; inserting a slider body and one or more stops at or adjacent each gap section using a second machine; and introducing a cut to the discontinuous zipper chain at each gap section using the second machine to form individual zipper assemblies for use in apparel manufacturing.

In a feature of this aspect, the first machine is a sewing machine.

In another feature of this aspect, the flaps are zipper fly flaps for pants or jeans garments.

In another feature of this aspect, the discontinuous zipper chain includes metal zipper teeth. In another feature of this aspect, the discontinuous zipper chain includes polymeric zipper teeth. In another feature of this aspect, the discontinuous zipper chain includes coil-type zipper teeth.

Broadly defined, the present invention according to another aspect includes a method of preparing zipper assemblies for use in apparel manufacturing. The method includes, at a first location, programming a teeth-securing machine to secure zipper teeth at specified intervals along an edge of each of a pair of zipper tapes, and feeding the pair of zipper tapes into the teeth-securing machine so as to secure interlocking zipper teeth to the zipper tapes at the specified intervals, thereby forming a discontinuous zipper chain having successive toothed sections positioned along a length thereof and spaced apart from one another by gap sections without zipper teeth. The method further includes transferring the discontinuous zipper chain from the first location to a second location. The method still further includes, at the second location, securing flaps to the discontinuous zipper chain using a first machine, inserting a slider body and one or more stops at or adjacent each gap section using a second machine, and introducing a cut to the discontinuous zipper chain at each gap section using the second machine to form individual zipper assemblies for use in apparel manufacturing.

In a feature of this aspect, an interval length of each specified interval is uniform along the length of the discontinuous zipper chain.

In another feature of this aspect, the first machine is a sewing machine.

In another feature of this aspect, the method further includes, prior to the transferring step, spooling or packaging the discontinuous zipper chain.

In another feature of this aspect, the flaps are zipper fly flaps for pants or jeans garments.

In another feature of this aspect, the discontinuous zipper chain includes metal zipper teeth. In another feature of this aspect, the discontinuous zipper chain includes polymeric zipper teeth. In another feature of this aspect, the discontinuous zipper chain includes coil-type zipper teeth.

Broadly defined, the present invention according to another aspect includes a method for preparing discontinuous zipper chain for use in garment or apparel manufacturing processes as substantially as shown and described.

Broadly defined, the present invention according to another aspect includes a method for processing discontinuous zipper chain to form individual zipper assemblies for use in garment or apparel manufacturing as substantially as shown and described.

Broadly defined, the present invention according to another aspect includes a discontinuous zipper chain as substantially shown and described.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein.

DETAILED DESCRIPTION

Figure 1:
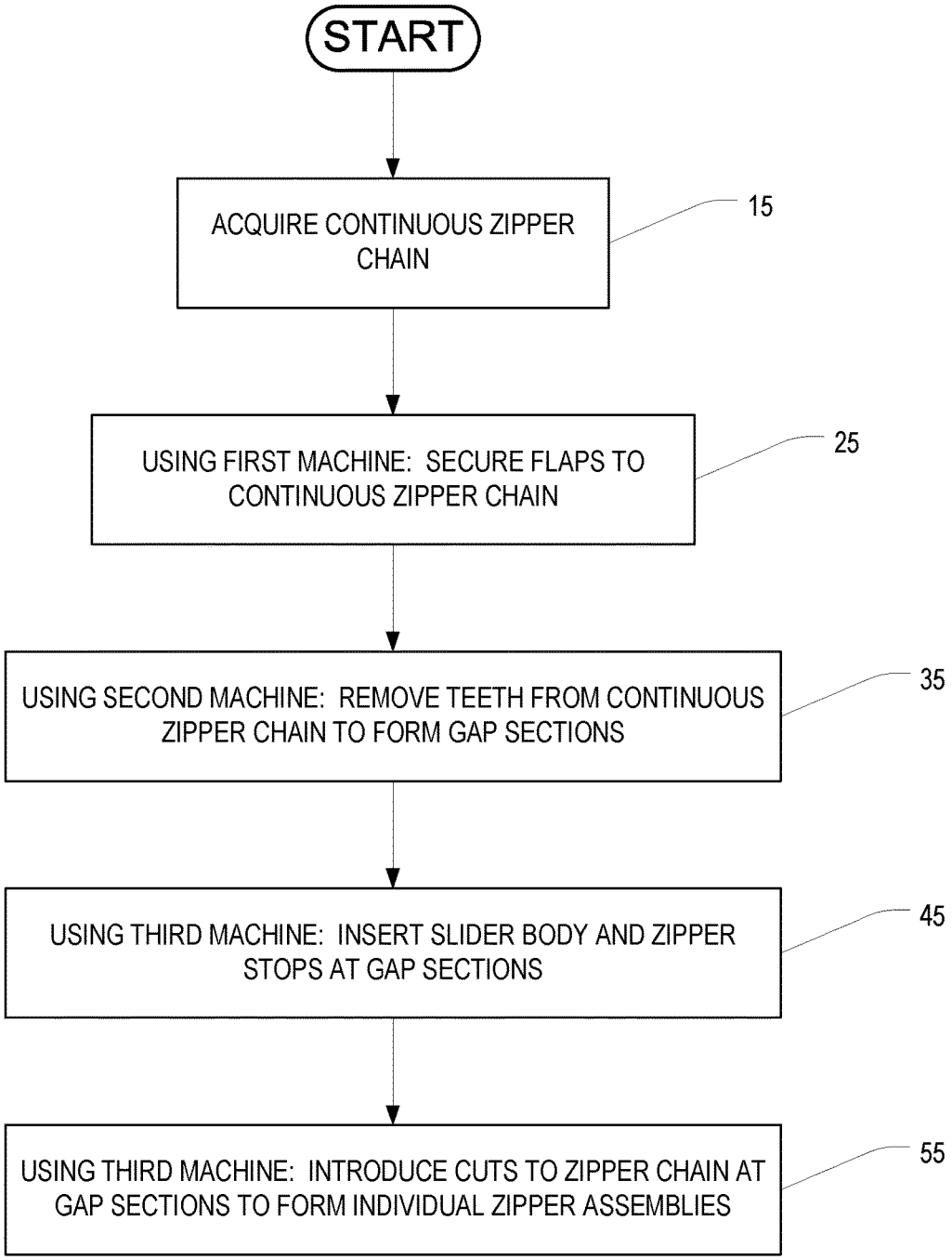
prior art FIG. 1
FIG. 1 is a flowchart of a conventional method for processing continuous zipper chain to form individual zipper assemblies for use in apparel manufacturing.
Figure 2A:
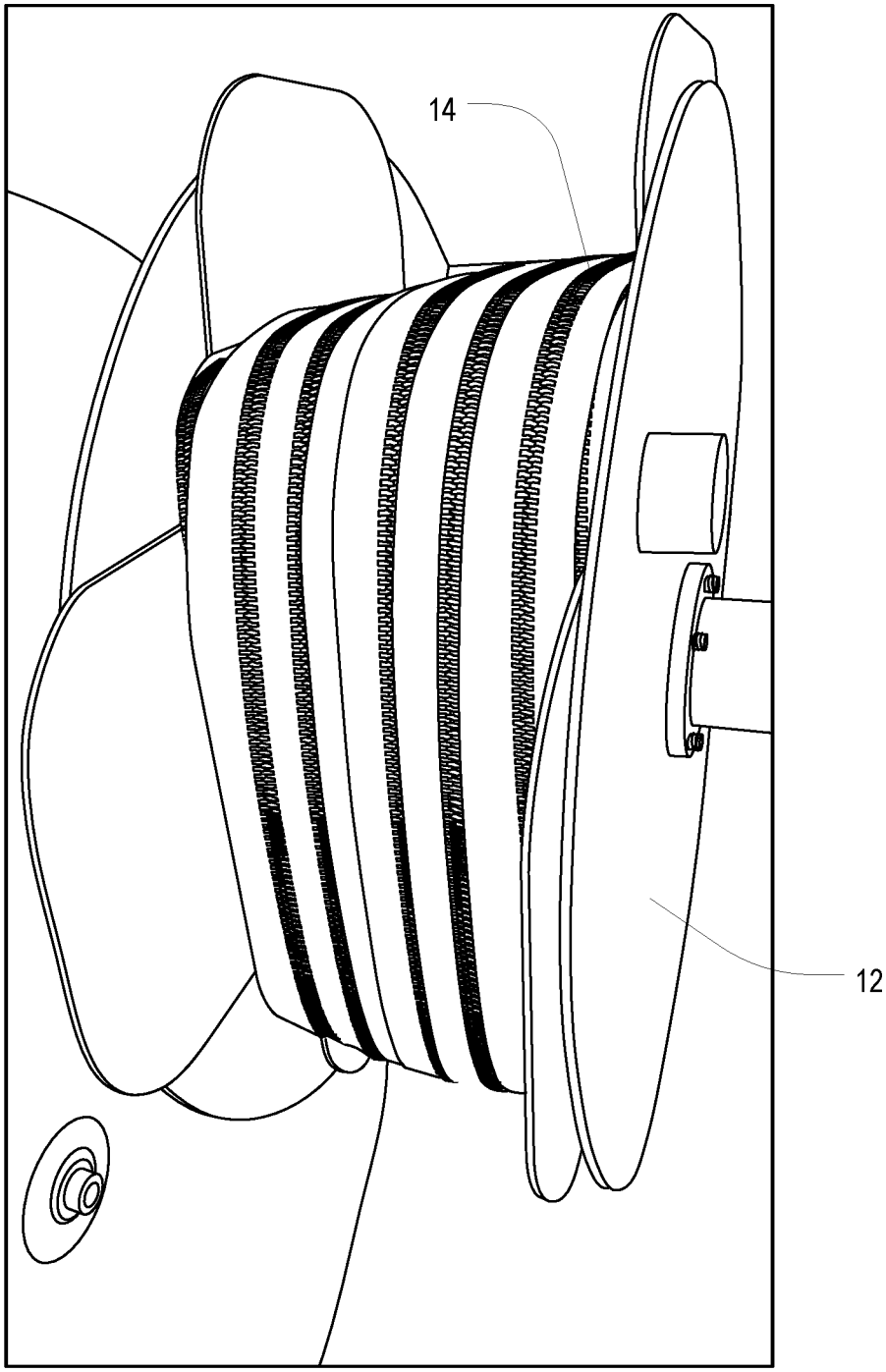
prior art FIG. 2A
FIG. 2A is a perspective view of a spool containing continuous zipper chain for use in apparel manufacturing.
Figure 2B:
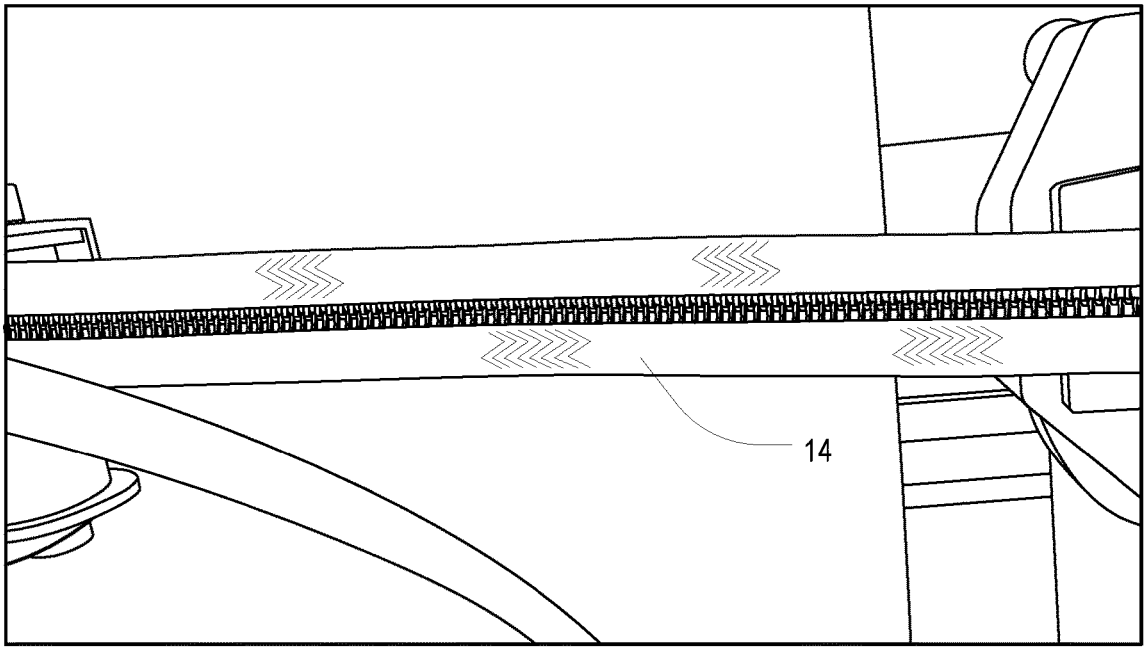
prior art FIG. 2B
FIG. 2B is a close-up perspective view of a portion of the continuous zipper chain of FIG. 2A.
Figure 3:
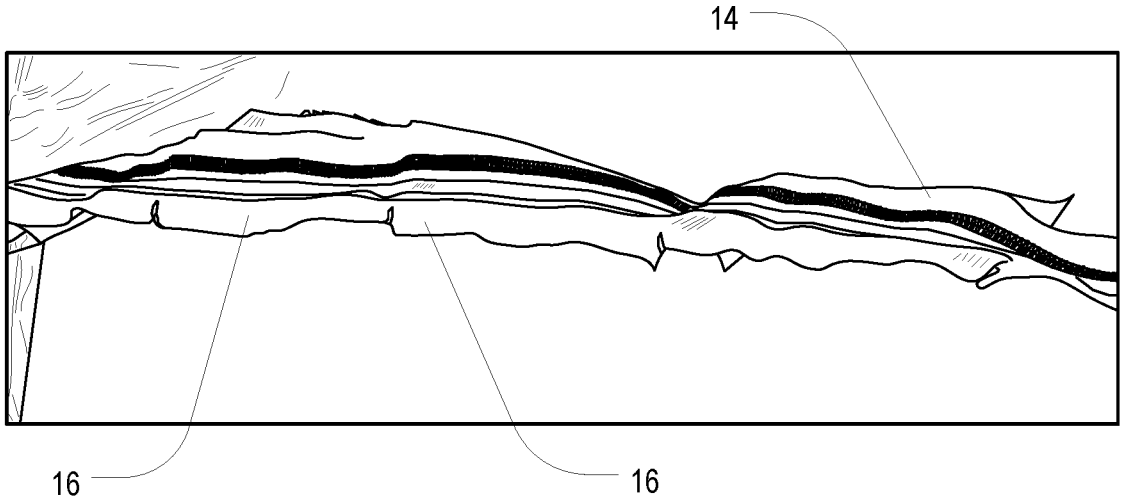
prior art FIG. 3
FIG. 3 is a close-up perspective view of a portion of the continuous zipper chain of FIG. 2A with flaps sewn thereto.
Figure 4A:
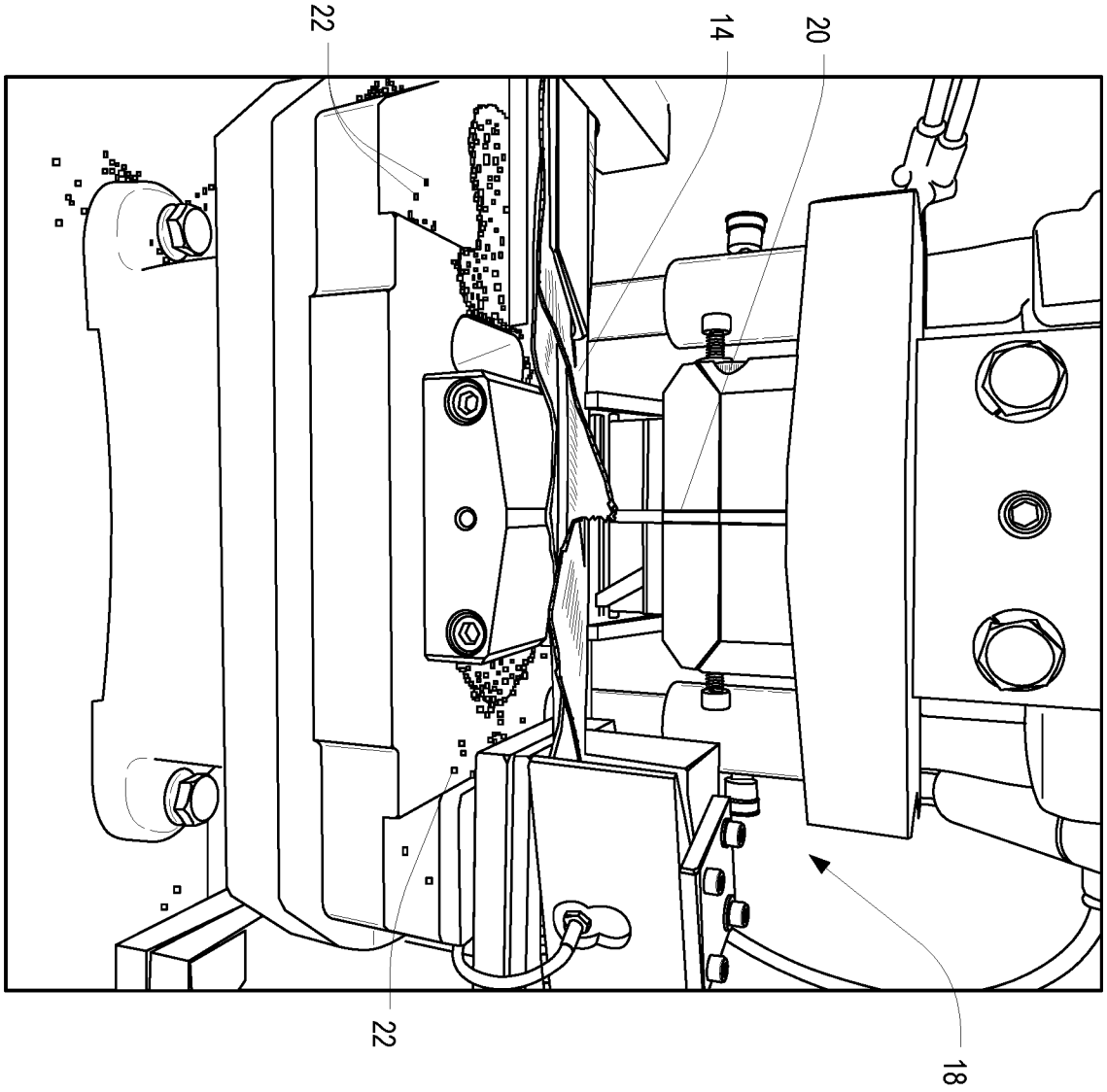
prior art FIG. 4A
FIG. 4A is a perspective view of a gapping machine having a die punch.
Figure 4B:
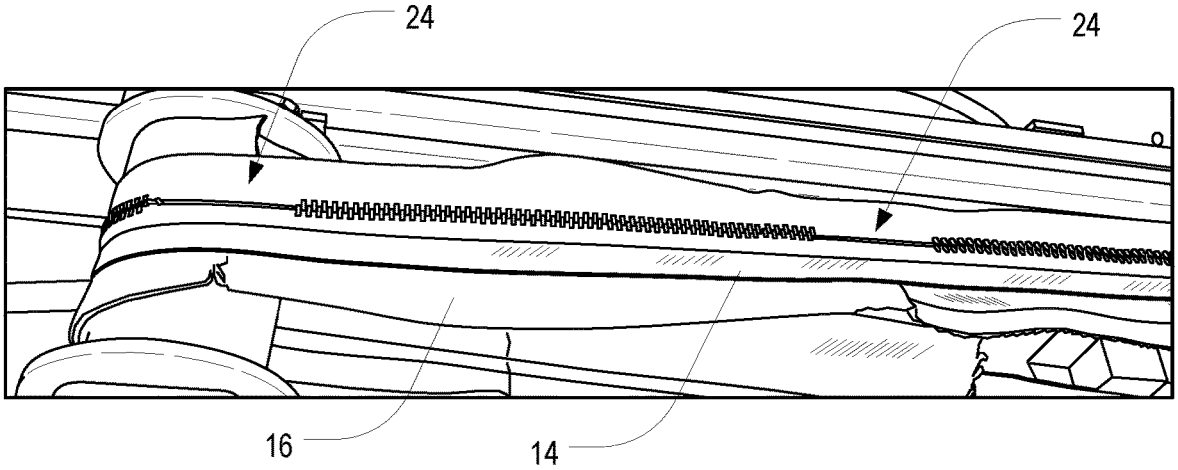
prior art FIG. 4B
FIG. 4B is a perspective view of a zipper chain having teeth removed therefrom to form gap sections along the length thereof.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. § 112, ¶ 6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers," "a picnic basket having crackers without cheese," and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, in which like numerals represent like components throughout the several views, one or more preferred embodiments of the present invention are next described. The following description of one or more preferred embodiment(s) is merely exemplary in nature and is in no way intended to limit the invention, its application, or uses.

In accordance with one or more aspects of the present invention, it is contemplated that the zipper chain for acquisition by garment and apparel manufacturers can be prepared in such a way as to reduce or substantially eliminate inefficiencies noted hereinabove. In this regard, FIG. 5 is a flowchart of a method 110 for preparing discontinuous zipper chain in accordance with one or more aspects of the present invention.

Figure 5:
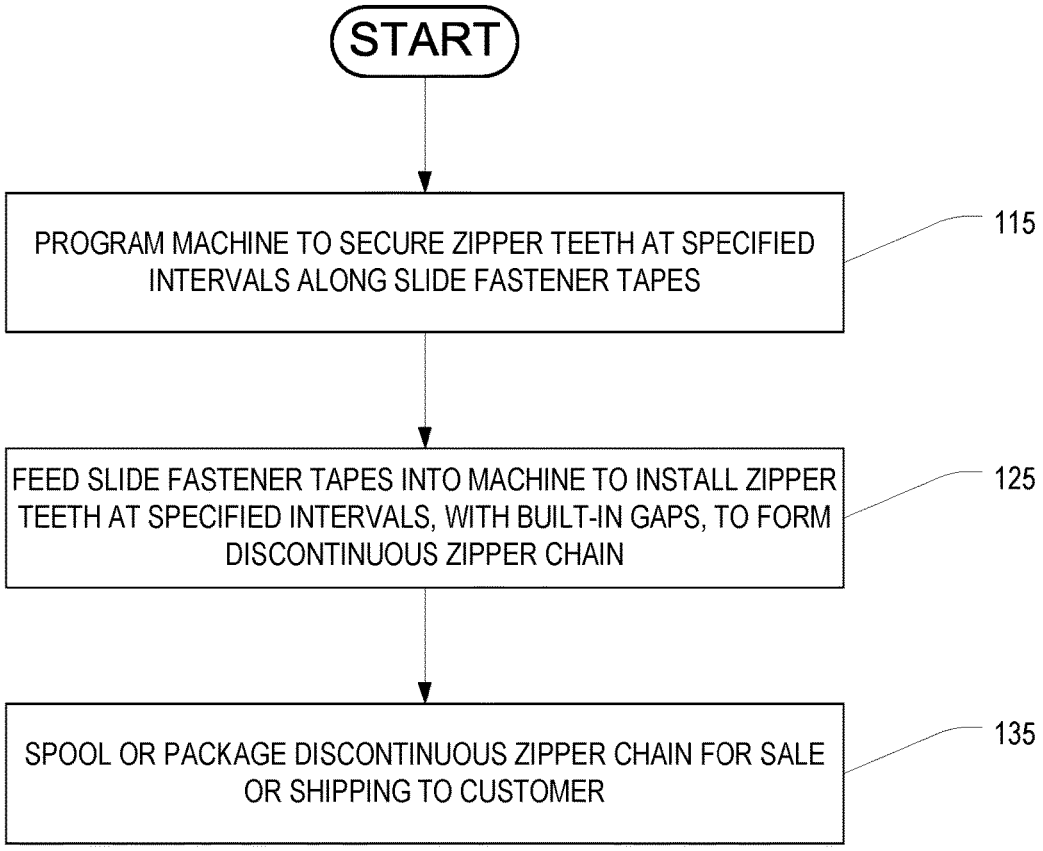
FIG. 5 is a flowchart of a method for preparing discontinuous zipper chain in accordance with one or more aspects of the present invention.

In accordance with FIG. 5, it is contemplated that zipper teeth can be secured to the zipper tapes in a discontinuous manner. At step 115, a machine for securing zipper teeth to the zipper tapes is tuned or preset with instructions to install teeth at specified intervals along running lengths of the zipper tapes. In this manner, the formation of precise and consistent gaps between sections of zipper teeth can be configured into the machine.

At step 125 of FIG. 5, zipper tapes are fed through the teeth-securing machine, and zipper teeth are installed onto the tapes at the specified intervals. Practically, the machine follows the provided instructions and either secures teeth to each of the zipper tapes as they pass through the machine or allows the tapes to pass through a precise and consistently repeated distance without securing teeth. By programming or configuring the machine in this manner, no operator role would be required. It is contemplated that the teeth-securing machine can automatically prepare the discontinuous zipper chain, with built-in gaps, in accordance with the provided instructions.

At step 135 of FIG. 5, the formed discontinuous zipper chain is spooled or otherwise packaged for sale and shipping from one location to another, where apparel and garment manufacturers may further process the chain. Because gapped locations have already been introduced to the zipper chain, the shipping weight of the zipper chain is more in line with the true weight of the material being used in the manufacturing process. Furthermore, with a shipping weight that does not include the weight of material ultimately to be discarded, the cost to ship discontinuous zipper chain is less than a continuous zipper chain of similar length. Still further, the apparel or garment manufacturer does not have to be concerned with issues pertinent to recycling or discarding removed teeth, which may include heavy metals or other coatings that are difficult or costly to recycle.

It is contemplated that different kinds of zipper teeth can be secured to the zipper tapes, as might be preferred in accordance with different types of apparel or garments to be manufactured. In this regard, it is contemplated that metal zipper teeth, which are commonly used for the zipper fly in pants and jeans garments, can be secured to the zipper tapes in a discontinuous manner. In other contemplated embodiments, polymer zipper teeth or coil-type zipper teeth may likewise each be secured to the zipper tapes in a discontinuous manner.

It is further contemplated that a spool or package of discontinuous zipper chain may be prepared in such a way that each section of zipper teeth included on the spool or in the package has the same length. In this manner, individual spools or packages of discontinuous zipper chain can be identified by or designated with a length measurement corresponding to the length of the sections of zipper chain included on the spool or in the package. As a result, it is contemplated that spools or packages of discontinuous zipper chain may correspond with a distinct stock-keeping unit that can be used to identify the length of zipper teeth in each section of the discontinuous chain retained on the spool or in the package.

Spools or packages of discontinuous zipper chain can be sold or otherwise transferred to apparel and garment manufacturers for use in connection with simplified manufacturing processes. In this regard, FIG. 6 is a flowchart of a method 210 for processing discontinuous zipper chain to form individual zipper assemblies for use in apparel manufacturing in accordance with one or more aspects of the present invention.

Figure 6:
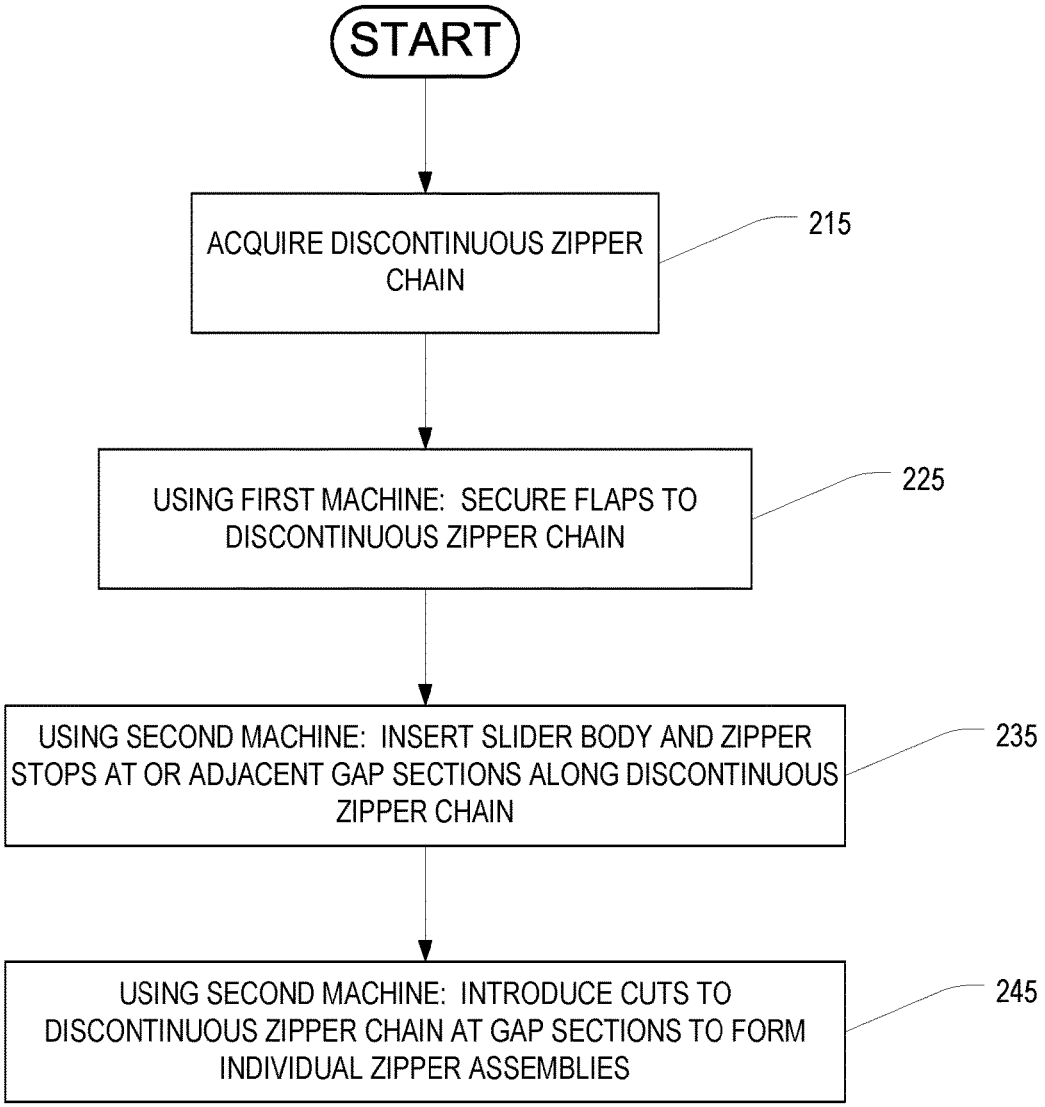
FIG. 6 is a flowchart of a method for processing discontinuous zipper chain to form individual zipper assemblies for use in apparel manufacturing in accordance with one or more aspects of the present invention.

In accordance with FIG. 6, a spool or package of discontinuous zipper chain is acquired at step 215. It is contemplated that the acquired discontinuous zipper chain may be assembled in accordance with the method described hereinabove in connection with FIG. 5.

At step 225 of the method 210 of FIG. 6, a first machine is used to secure zipper fly flaps for pants or jeans to the discontinuous zipper chain. In at least some embodiments, it is contemplated that the first machine is a sewing machine that sews flaps to one or both of the zipper tapes of the discontinuous zipper chain in an end-to-end, continuous manner. The flaps are commonly formed of a fabric material of the type that is preferred for the particular garment to be made. It is contemplated that flaps are attached so that a set of flaps corresponds with each section of zipper teeth of the discontinuous chain.

At step 235 of the method of FIG. 6, a second machine is used to insert a slider body and zipper stops at or adjacent the gap sections along the discontinuous zipper chain. The gap sections, having no teeth, provide locations to accommodate hardware at each section of zipper teeth so that each may be independently functional as a zipper assembly. The slider body is positioned onto the teeth so that the teeth from each zipper tape can be zipped or unzipped, and the zipper stops provide a physical obstacle at the ends of each section of zipper chain to prevent the slider body from exiting the teeth. At step 245 of the method of FIG. 1, the second machine is also used to introduce cuts to the zipper chain at each of the gap locations, thereby forming individual zipper assemblies that can be sewn to a garment for use as a zipper fly.

In accordance with FIGS. 5 and 6, apparel or garment manufacturers can eliminate entire steps in the manufacturing process by utilizing a discontinuous zipper chain, with built-in gaps, instead of a continuous zipper chain. It is contemplated that this can be particularly useful in a linear manufacturing process where a need to use a gapping machine (for teeth removal) can be eliminated by utilizing a discontinuous zipper chain in lieu of a continuous zipper chain.

Based on the foregoing information, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof.

What is claimed is:

1. A method for preparing discontinuous zipper chain for use in apparel manufacturing, the method comprising:

programming a teeth-securing machine to secure zipper teeth at specified intervals along an edge of each of a pair of zipper tapes;

feeding the pair of zipper tapes into the teeth-securing machine so as to secure interlocking zipper teeth to the zipper tapes at the specified intervals, thereby forming a discontinuous zipper chain having successive toothed sections positioned along a length thereof and spaced apart from one another by gap sections without zipper teeth; and spooling or packaging the discontinuous zipper chain for use in apparel manufacturing.

2. The method of claim 1, wherein the discontinuous zipper chain includes metal zipper teeth.

3. The method of claim 1, wherein the discontinuous zipper chain includes polymeric zipper teeth.

4. The method of claim 1, wherein the discontinuous zipper chain includes coil-type zipper teeth.

5. The method of claim 1, wherein an interval length of each specified interval is uniform along the length of the discontinuous zipper chain.

6. A method for processing discontinuous zipper chain to form individual zipper assemblies for use in apparel manufacturing, the method comprising:

acquiring a supply of a discontinuous zipper chain having successive toothed sections positioned along a length thereof and spaced apart from one another by gap sections without zipper teeth;

securing flaps to the discontinuous zipper chain using a first machine;

inserting a slider body and one or more stops at or adjacent each gap section using a second machine; and introducing a cut to the discontinuous zipper chain at each gap section using the second machine to form individual zipper assemblies for use in apparel manufacturing.

7. The method of claim 6, wherein the first machine is a sewing machine.

8. The method of claim 6, wherein the flaps are zipper fly flaps for pants or jeans garments.

9. The method of claim 6, wherein the discontinuous zipper chain includes metal zipper teeth.

10. The method of claim 6, wherein the discontinuous zipper chain includes polymeric zipper teeth.

11. The method of claim 6, wherein the discontinuous zipper chain includes coil-type zipper teeth.

12. A method of preparing zipper assemblies for use in apparel manufacturing, the method comprising:

at a first location, programming a teeth-securing machine to secure zipper teeth at specified intervals along an edge of each of a pair of zipper tapes, and feeding the pair of zipper tapes into the teeth-securing machine so as to secure interlocking zipper teeth to the zipper tapes at the specified intervals, thereby forming a discontinuous zipper chain having successive toothed sections positioned along a length thereof and spaced apart from one another by gap sections without zipper teeth;

transferring the discontinuous zipper chain from the first location to a second location; and at the second location, securing flaps to the discontinuous zipper chain using a first machine, inserting a slider body and one or more stops at or adjacent each gap section using a second machine, and introducing a cut to the discontinuous zipper chain at each gap section using the second machine to form individual zipper assemblies for use in apparel manufacturing.

13. The method of claim 12, wherein an interval length of each specified interval is uniform along the length of the discontinuous zipper chain.

14. The method of claim 12, wherein the first machine is a sewing machine.

15. The method of claim 12, further comprising, prior to the transferring step, spooling or packaging the discontinuous zipper chain.

16. The method of claim 12, wherein the flaps are zipper fly flaps for pants or jeans garments.

17. The method of claim 12, wherein the discontinuous zipper chain includes metal zipper teeth.

18. The method of claim 12, wherein the discontinuous zipper chain includes polymeric zipper teeth.

19. The method of claim 12, wherein the discontinuous zipper chain includes coil-type zipper teeth.

* * * * *